US008188881B2

(12) United States Patent
Mandrou et al.

(10) Patent No.: US 8,188,881 B2
(45) Date of Patent: May 29, 2012

(54) SYSTEM AND METHOD FOR CONTROLLING MULTIPLE WELL TOOLS

(75) Inventors: Laure Mandrou, Pearland, TX (US); Michael J. Bertoja, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1099 days.

(21) Appl. No.: 12/055,797

(22) Filed: Mar. 26, 2008

(65) Prior Publication Data

US 2009/0243875 A1 Oct. 1, 2009

(51) Int. Cl.
*G01V 3/00* (2006.01)

(52) U.S. Cl. ..... 340/853.3; 340/854.9; 166/375

(58) Field of Classification Search ..... 340/853.3, 340/854.9; 166/375
See application file for complete search history.

(56) References Cited

U.S. PATENT DOCUMENTS

| | | | | |
|---|---|---|---|---|
| 5,529,126 | A | 6/1996 | Edwards | |
| 5,691,712 | A | 11/1997 | Meek | |
| 6,012,518 | A | 1/2000 | Pringle | |
| 6,179,052 | B1 | 1/2001 | Purkis | |
| 6,247,536 | B1 | 6/2001 | Leismer | |
| 6,491,102 | B2 | 12/2002 | Leismer | |
| 6,561,289 | B2 | 5/2003 | Portman | |
| 6,575,237 | B2 | 6/2003 | Purkis | |
| 6,659,184 | B1 | 12/2003 | Tips et al. | |
| 7,145,471 | B2 | 12/2006 | Purkis et al. | |
| 7,182,139 | B2 * | 2/2007 | Rayssiguier et al. | 166/374 |
| 2003/0048197 | A1 | 3/2003 | Purkis et al. | |
| 2007/0120704 | A1 | 5/2007 | Hudson | |
| 2007/0175637 | A1 * | 8/2007 | Leising et al. | 166/297 |

FOREIGN PATENT DOCUMENTS

GB 2401617 A 11/2004

* cited by examiner

*Primary Examiner* — Shane Bomar
*Assistant Examiner* — Catherine Loikith
(74) *Attorney, Agent, or Firm* — Brandon S. Clark; Rodney Warfford; Robert Van Someren

(57) ABSTRACT

Systems and methods for downhole completions. A downhole running tool can have a body having a bore formed therethrough. A latch member can be disposed on a first portion of the body. A reset member can be disposed on a second portion of the body. A conduit can be formed within a sidewall of the body. The conduit can be located between the first and second portions of the body. A pressure relief port can be disposed at a first end of the conduit; and a first flow port can be disposed at a second end of the conduit. The pressure relief port and first flow port can be in communication with an outer diameter of the body.

23 Claims, 12 Drawing Sheets

| Indexers increment | Module #1 | Module #2 | Module #3 | ... |
|---|---|---|---|---|
| 1 | **Actuation** | No Actuation | No Actuation | |
| 2 | No Actuation | **Actuation** | No Actuation | |
| 3 | No Actuation | No Actuation | **Actuation** | |
| ... | | | | |

| Indexers increment | Module #1 | Module #2 | Module #3 | ... |
|---|---|---|---|---|
| 1 | **Actuation** | **Actuation** | **Actuation** | |
| 2 | **Actuation** | No Actuation | No Actuation | |
| 3 | No Actuation | **Actuation** | No Actuation | |
| 4 | No Actuation | No Actuation | **Actuation** | |
| ... | | | | |

| Indexers increment | Module #1 | Module #2 | Module #3 | ... |
|---|---|---|---|---|
| 1 | **Open Tool** | No Move | No Move | |
| 2 | **Close Tool** | No Move | No Move | |
| 3 | No Move | **Open Tool** | No Move | |
| 4 | No Move | **Close Tool** | No Move | |
| 5 | No Move | No Move | **Open Tool** | |
| 6 | No Move | No Move | **Close Tool** | |
| ... | | | | |

| Indexers increment | Module #1 | Module #2 | Module #3 | .... |
|---|---|---|---|---|
| 1 | **Open Tool** | **Open Tool** | **Open Tool** | |
| 2 | **Close Tool** | **Close Tool** | **Close Tool** | |
| 3 | **Open Tool** | No Move | No Move | |
| 4 | **Close Tool** | No Move | No Move | |
| 5 | No Move | **Open Tool** | No Move | |
| 6 | No Move | **Close Tool** | No Move | |
| 7 | No Move | No Move | **Open Tool** | |
| 8 | No Move | No Move | **Close Tool** | |
| .... | | | | |

SYSTEM AND METHOD FOR CONTROLLING MULTIPLE WELL TOOLS

BACKGROUND

In many subterranean environments, such as wellbore environments, downhole tools are used to carry out a variety of procedures. For example, downhole tools may comprise a variety of flow control valves, safety valves, flow controllers, packers, gas lift valves, sliding sleeves, and other well tools. Many of these well tools can be hydraulically controlled via input from hydraulic control lines that are run downhole. Conventional well tools often rely on a dedicated hydraulic control line or lines routed to a specific tool positioned in a wellbore. The number of well tools placed downhole can be limited by the number of control lines available in a given wellbore. The wellbore and/or wellbore equipment, e.g. packers, used in a given application also can provide space constraints or routing constraints which limit the number of control lines. Furthermore, even in applications that would allow the addition of control lines, the additional lines tend to slow installation and increase the cost of installing equipment downhole.

Attempts have been made to reduce the number of hydraulic control lines necessary to carry out given well related procedures. For example, multiplexers have been used to limit the number of hydraulic control lines. However, multiplexing systems often rely on an ability to generate multiple levels of pressure that are interpreted downhole. In some custom designed systems, the maximum number of well tools is limited to a number equal to the number of hydraulic control lines. In other attempts, electric/solenoid controlled valves or custom hydraulic devices and tools have been designed to respond to pressure pulse sequences delivered downhole. However, many such systems have proved to be fairly costly and relatively slow to actuate.

SUMMARY

In general, the present invention provides a system and method for controlling multiple well tools. A plurality of well tools can be actuated between operational positions. The well tools are coupled to a plurality of multidrop modules with each multidrop module typically being coupled to one or two well tools. A plurality of control lines are connected to the multidrop modules, and the number of multidrop modules and attached well tools can be greater than the number of control lines. Also, each well tool can be actuated individually by providing pressure inputs through one or more of the control lines. The pressure inputs can be provided at a single pressure level.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for controlling well tools. A multidrop module is deployed between a well tool and control lines that extend to the surface. Multiple well tools and associated multidrop modules can be coupled to the control lines, and the multidrop modules require only one level of pressure for operation. Use of the multidrop modules enables selection of one or several well tools for actuation out of all of the well tools deployed. Additionally, each multidrop module is able to memorize the last selection made based on the pressure input delivered downhole via the control lines.

Figure 1:
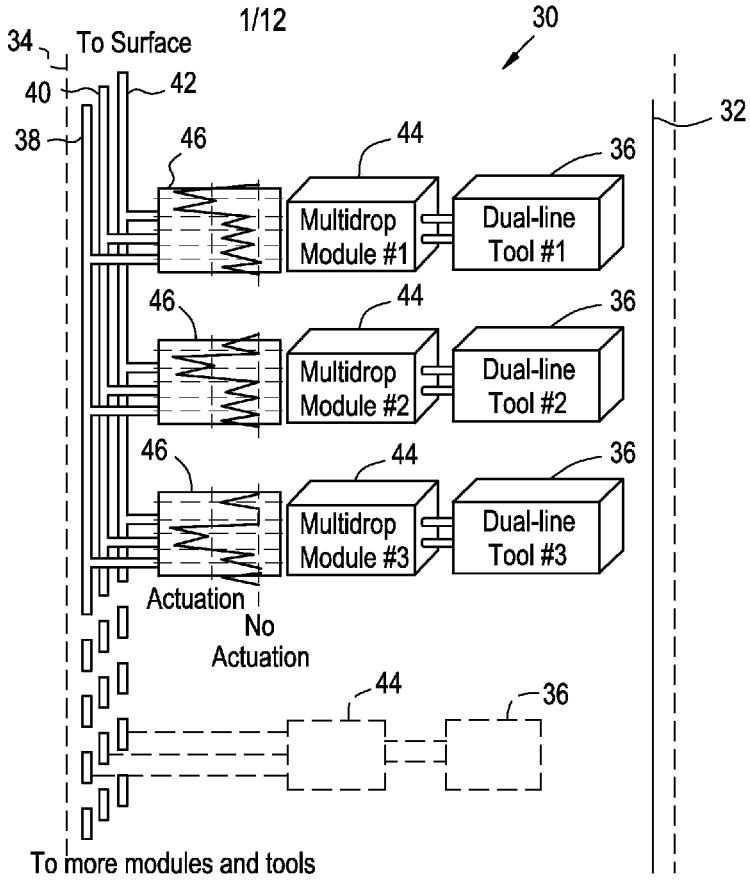
FIG. 1 is a schematic view of a well tool actuation system having a plurality of well tools and multidrop modules deployed in a wellbore, according to an embodiment of the present invention.

Referring generally to FIG. 1, one embodiment of a well tool actuation system 30 is illustrated. The actuation system 30 may be mounted along or otherwise coupled to equipment 32 used in a subterranean environment, e.g. a wellbore environment. Equipment 32 comprises, for example, a downhole completion or other equipment utilized in a wellbore 34, such as an oil or gas related wellbore.

In the embodiment illustrated, well tool actuation system 30 comprises a plurality of well tools 36. Actuation of well tools 36 is based on fluid inputs supplied along a plurality of control lines, e.g. control lines 38, 40 and 42 (1, 2 and 3). In this embodiment, three control lines are utilized, and the control lines extend upwardly to, for example, a surface location. The number of well tools 36 that can be controlled independently can be greater and even substantially greater than the number of control lines. In FIG. 1, the well tool illustrated in dashed lines represents one or more well tools in addition to the other illustrated well tools.

Figure 2:
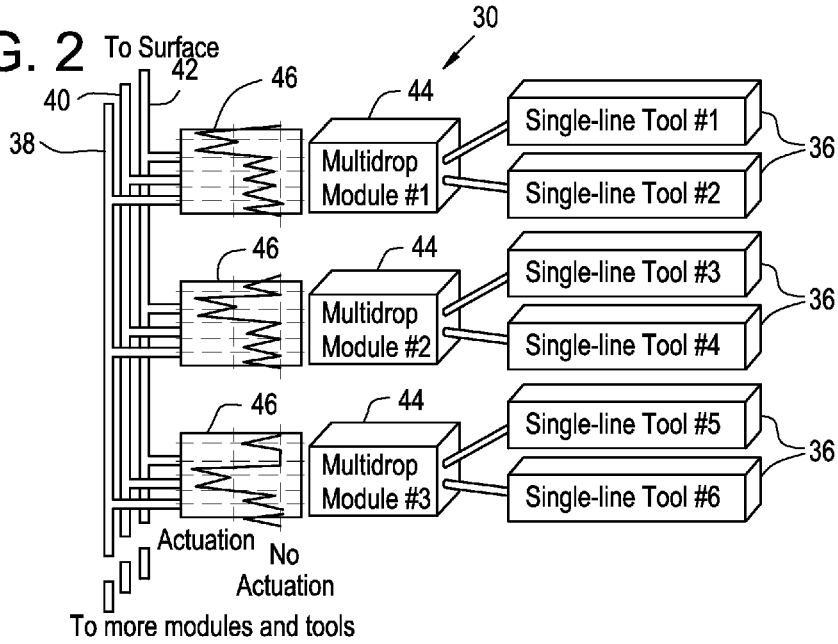
FIG. 2 is a schematic illustration of another example of the well tool actuation system, according to an alternate embodiment of the present invention.

The well tools 36 can be actuated by fluid, such as hydraulic fluid flowing through one or more of the control lines 38, 40, 42. Additionally, the plurality of well tools 36 may comprise a variety of well tool types and combinations of tools depending on the application. For example, the well tools 36 may comprise flow control valves, flow controllers, packers, gas lift valves, sliding sleeves, and other tools that can be actuated by a fluid, e.g. hydraulic fluid. In FIG. 1, the well tools 36 are illustrated as dual-line tools that are actuated via inputs from two control lines. However, the well tools 36 also may comprise single-line tools, as illustrated in FIG. 2.

As illustrated in FIG. 1, each dual-line well tool 36 is coupled with a multidrop module 44 that may be positioned downhole proximate the corresponding well tool 36. In the embodiment illustrated in FIG. 2, a pair of single-line tools can be coupled with each multidrop module 44. The plurality of multidrop modules 44 serves to control the flow of actuating fluid and thus the actuation of the corresponding well tools 36. In the embodiments illustrated, each well tool can be actuated individually via single level pressure inputs provided to the multidrop modules 44 through, for example, one of the control lines. Each multidrop module 44 has a specific program, as illustrated schematically in the diagrams labeled with reference numeral 46 in FIG. 1. For example, each multidrop module 44 can be programmed to respond and to enable actuation of its corresponding well tool 36 upon receipt of a specific number of pressure pulses. The number of pressure pulses, e.g. single level pressure pulses, applied can be detected and tracked by indexers that are unique to specific multidrop modules 44, as explained in greater detail below.

Figure 3:
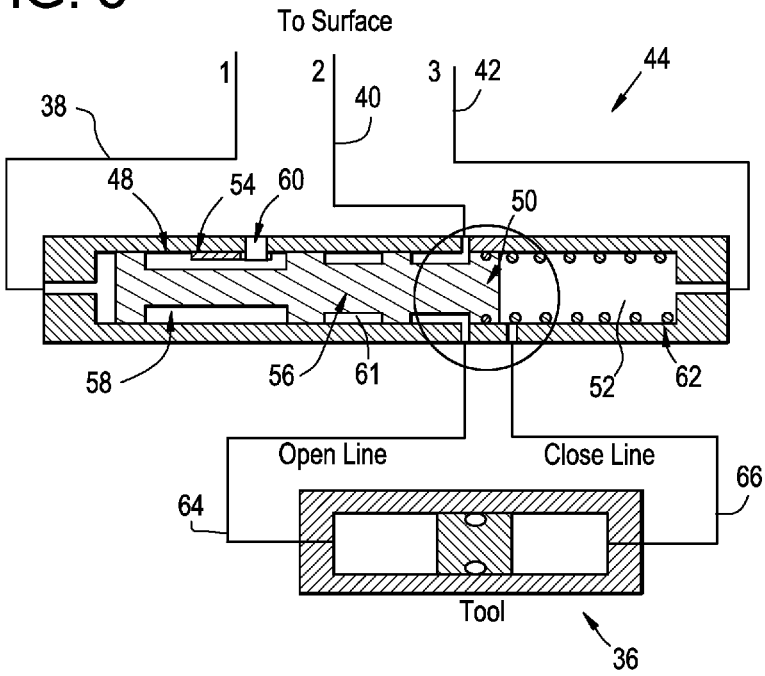
FIG. 3 is a schematic illustration of one example of a multidrop module utilized in the well tool actuation system, according to an embodiment of the present invention.

Referring generally to FIG. 3, one embodiment of a multidrop module 44 is illustrated. In this embodiment, each multidrop module 44 comprises a housing 48 containing a valve 50, such as a two position valve, that may be positioned between an actuation position and a no-actuation position. By way of example, valve 50 may be mounted within housing 48 for translating/sliding motion along an interior 52 of housing 48. Valve 50 is operatively coupled with an indexer 54 across a piston 56. In this example, indexer 54 comprises an indexer sleeve 58 and a cooperating indexer pin 60 that may be mounted to housing 48. The indexer 54 may be a two-position/x-increments, J-slot indexer programmed to shift the multidrop module 44 to an actuation position at a predetermined number of pressure inputs applied to the indexer 54 via control line 38.

As illustrated, a seal 61 may be positioned about piston 56 to form a seal with an interior surface of housing 48. Additionally, a return spring 62 can be positioned within housing 48 to act against valve 50 in a direction that provides a bias against the pressure applied to indexer 54 and piston 56 via control line 38. For example, valve 50 is displaced via piston 56 when a pressure input is applied through control line 38, and return spring 62 returns valve 50 in an opposite direction once the pressure input is reduced.

When pressure is applied to control line 38, the piston 56 moves against spring 62 and compresses the spring. The stroke of piston 56 is limited by the slot profile of indexer sleeve 58 and the cooperating indexer pin 60. When pressure is bled from control line 38, the return spring 62 forces piston 56 in an opposite direction. Again, the slot profile of indexer sleeve 58 and cooperating indexer pin 60 limits the stroke of piston 56 and thus determines its final position. Each time pressure is applied via control line 38, the indexer 54 is advanced to its next increment. Depending on the specific indexer program, e.g. indexer slot profile, valve 50 either remains at its current position or is shifted to its other position. For example, indexer 54 can be programmed with an appropriate slot profile so the valve 50 is in an "actuation" position at the first increment, i.e. following the first pressure input via control line 38, and subsequently remains in the "no-actuation" position for the remaining indexer increments. If the indexer 54 has x increments, then x applications of the pressure input, e.g. a single-level pressure input, through control line 38 moves the indexer through its entire profile.

Figure 4:
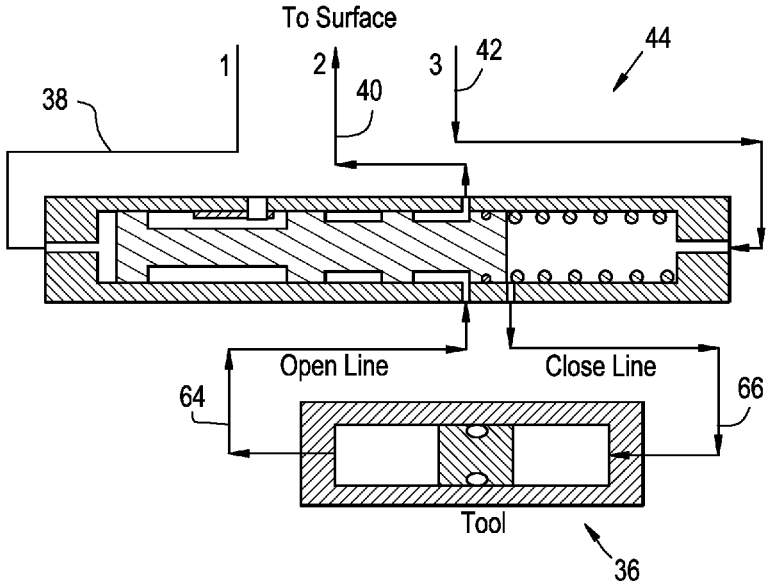
FIG. 4 is a view of the multidrop module illustrated in FIG. 3 but with a different flow pattern, according to another embodiment of the present invention.

In FIG. 3, valve 50 is positioned in an actuation position that enables actuation of the corresponding well tool 36. In this position, hydraulic power can be transmitted along control line 40, through multidrop module 44, and into a well tool actuation line 64 to actuate well tool 36 in a first direction. For example, if well tool 36 comprises a valve, actuation line 64 may be an "open" line that enables opening of the valve. When multidrop module 44 remains in this actuation position, hydraulic power also can be transmitted along control line 42, through multidrop module 44, and into a second well tool actuation line 66 to actuate well tool 36 to a different operational position, as illustrated in FIG. 4. If well tool 36 comprises a valve, for example, actuation line 66 may comprise a "close" line that enables closing of the valve. In some embodiments, the well tool 36 comprises a fluid volume that is returned during actuation. For example, actuation of well tool 36 via actuation line 64 causes the flow of return fluid along actuation line 66. Similarly, actuation of well tool 36 via actuation line 66 causes the flow of return fluid along line 64.

Figures 5, 6, 7:
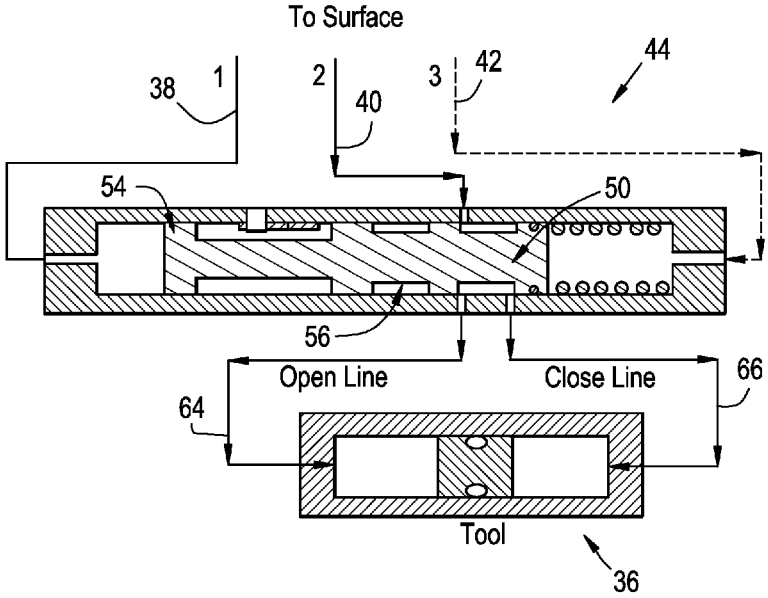
FIG. 5 is a view of the multidrop module illustrated in FIG. 3 but in a different state of actuation, according to another embodiment of the present invention.
FIG. 6 is a table illustrating one example of a multidrop module program for individually actuating specific well tools, according to an embodiment of the present invention.
FIG. 7 is a table illustrating another example of a multidrop module program for individually actuating specific well tools, according to an alternate embodiment of the present invention.

Upon application of the predetermined or programmed number of pressure inputs to multidrop module 44 via control line 38, indexer 54 and multidrop module 44 are shifted to the no-actuation position, as illustrated in FIG. 5. As illustrated, indexer 54, via piston 56, holds valve 50 at a position that prevents actuation of well tool 36 regardless of the pressure inputs applied along control line 40 or control line 42. The valve 50 remains in the no-actuation position until the appropriate number of pressure inputs are applied through control line 38 to cause shifting of indexer 54, and thus valve 50, back to the actuation position illustrated in FIG. 3.

Each indexer may be uniquely programmed, e.g. contain a unique slot profile, to correspond with the desired number of pressure inputs required to transition the multidrop module 44 from an actuation position to a no-actuation position and back again. The indexer program for each multidrop module is unique relative to the indexer program for other multidrop modules. In some embodiments, each multidrop module has its own unique program. Accordingly, every time control line 38 is pressurized with a pressure input, every multidrop module 44 transitions through an increment via its indexer 54. However, any resulting change in position of a specific valve 50 depends on the unique program or slot profile of its indexer. The indexers 54 of the various multidrop modules 44 can be programmed to enable selection of one tool at a time or several tools at a time. The changes, of course, are predictable based on the predetermined program, e.g. slot profile, of each indexer sleeve.

As illustrated in FIG. 6, for example, a plurality of multidrop modules 44 can be uniquely programmed. In this example, a first pressure input to the multidrop modules 44 causes shifting of the first module to an actuation position, while the second and third modules remain in a no-actuation position. A second pressure input causes the second incremental movement of the indexers 54 in each multidrop module 44, resulting in shifting of the second multidrop module to an actuation position and the first and third multidrop modules to a no-actuation position. A third pressure input applied to the multidrop modules causes the first and second modules to remain or shift to a no-actuation position, while the third multidrop module is transitioned to an actuation position. However, many different programs can be applied for shifting the multidrop modules between actuation and no actuation positions, as desired for a specific application. Additionally, multiple or all of the multidrop modules can be programmed to shift to an actuation position or a no-actuation position at the same time, as illustrated in FIG. 7. In this example, the first pressure input and the first incremental movement of the indexers 54 causes all of the illustrated multidrop modules to shift to an actuation position. Subsequent pressure inputs cause the multidrop modules to be individually transitioned between actuation and no-actuation positions, as illustrated.

Figure 8:
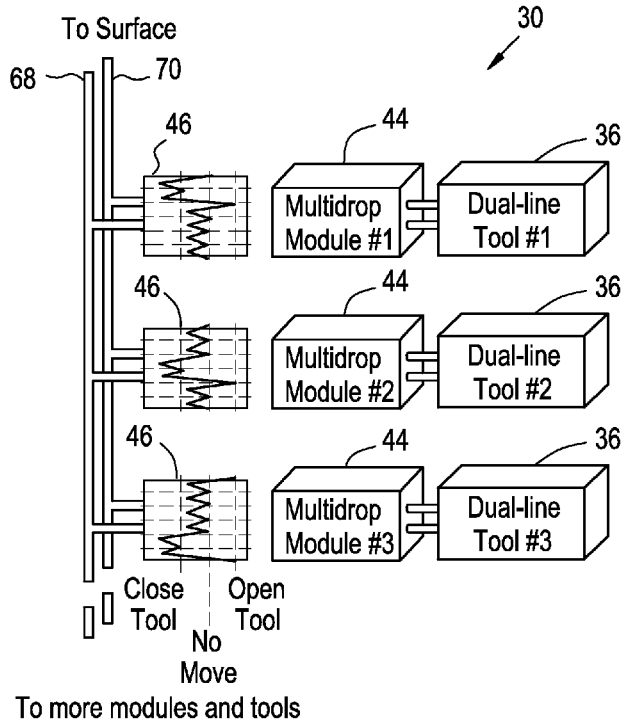
FIG. 8 is a schematic illustration of another example of the well tool actuation system, according to an alternate embodiment of the present invention.
Figure 9:
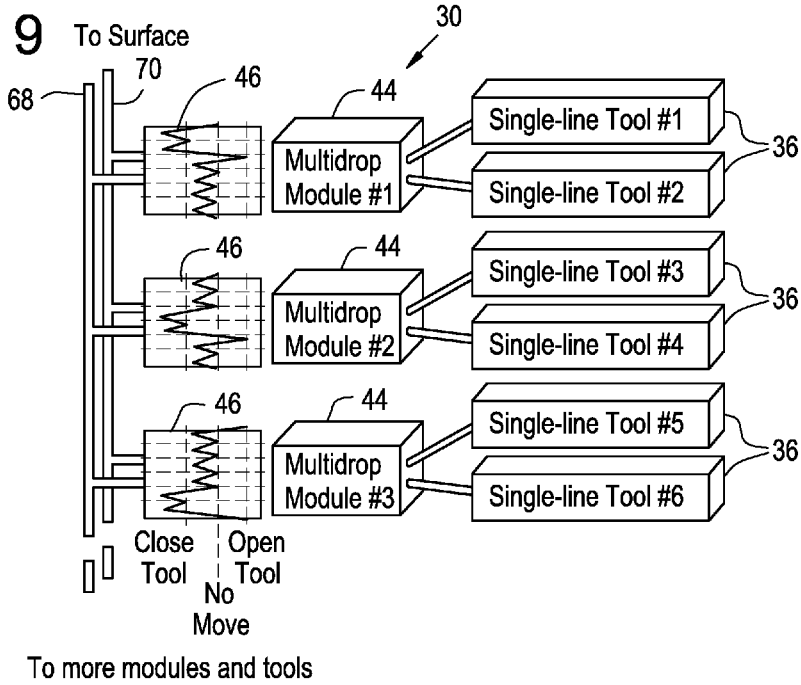
FIG. 9 is a schematic illustration of another example of the well tool actuation system, according to an alternate embodiment of the present invention.

Referring generally to FIGS. 8 and 9, another embodiment of well tool actuation system 30 as illustrated. In this embodiment, well tools 36 and multidrop modules 44 are controlled via a pair of control lines 68, 70. As illustrated, each multidrop module 44 can each be used to control the actuation of, for example, a single dual-line tool, as illustrated in FIG. 8. Alternatively, the multidrop modules 44 can be used to control the actuation of single-line tools 36, such as the pairs of single-line tools 36 controlled by each multidrop module 44, as illustrated in FIG. 9.

Figure 10:
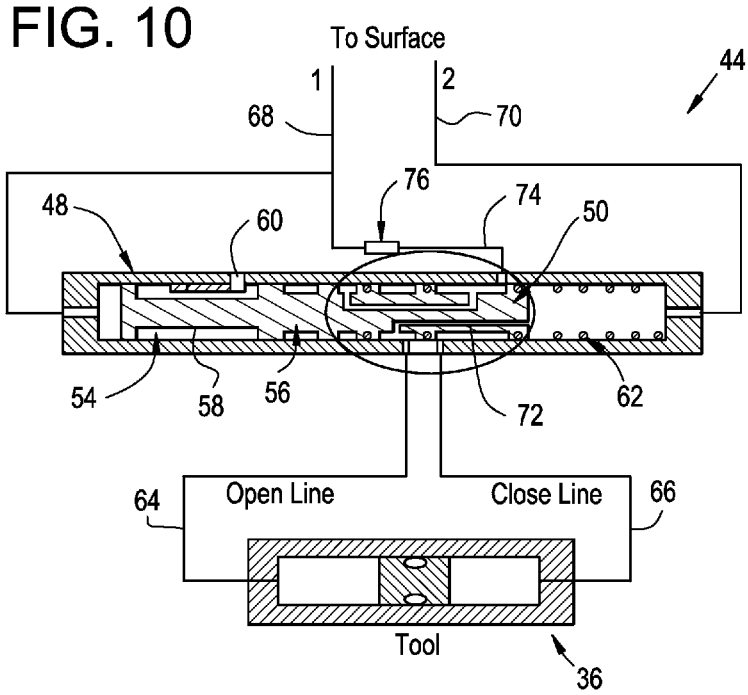
FIG. 10 is a schematic illustration of one example of a multidrop module utilized in the well tool actuation system illustrated in FIGS. 8 and 9, according to an embodiment of the present invention.

An example of a multidrop module 44 that can be utilized in a two control line system is illustrated in FIG. 10. In this embodiment, each multidrop module 44 again comprises the housing 48 that contains valve 50. However, valve 50 is a three position valve having three different operational positions comprising a first actuation position, a second actuation position, and a no-actuation position. If the well tool 36 comprises a valve or similar device, the first actuation position can be an "open tool" position and the second actuation position can be a "close tool" position. The three position valve 50 is operatively coupled with an indexer 54 across a piston 56. In this embodiment, however, indexer 54 comprises a three position indexer, such as a three position/x increment, J-slot indexer, able to shift valve 50 between its three operational positions.

When pressure is applied to control line 68, the piston 56 moves against spring 62 and compresses the spring. The stroke of piston 56 is limited by the slot profile of indexer sleeve 58 and the cooperating indexer pin 60. When pressure is bled from control line 68, return spring 62 forces piston 56 in an opposite direction. Again, the slot profile of indexer sleeve 58 and cooperating indexer pin 60 limits the stroke of piston 56 and thus determines its final position. Each time pressure is applied via control line 68, the indexer 54 is advanced to its next increment. Depending on the specific indexer program, e.g. indexer slot profile, valve 50 either remains at its current position or is shifted to its next position. For example, indexer 54 can be programmed with an appropriate slot profile so the valve 50 is in a "close tool" position at the first increment, in an "open tool" position for the second increment, and in the "no-actuation" position for the remaining indexer increments of the indexer profile. If the indexer 54 has x increments, then x applications of the pressure input, e.g. a single-level pressure input, through control line 68 moves the indexer through its entire profile and back to the "close tool" position.

In FIG. 10, valve 50 is positioned in the first actuation position, e.g. an open tool position, that enables actuation of the corresponding well tool 36 in a first direction. In this position, hydraulic power can be transmitted along control line 70, through multidrop module 44 (via, in part, a flow passage 72 through valve 50), and into the well tool actuation line 64 to actuate well tool 36 in a first direction, e.g. to open the well tool. Return fluid flows can be conducted through actuation line 66, through multidrop module 44, and into control line 68 via a secondary flow passage 74. A check valve 76 is placed along secondary flow passage 74 to allow movement of return flow from multidrop module 44 to control line 68 while blocking the reverse flow of fluid during application of pressure inputs through control line 68.

Figure 11:
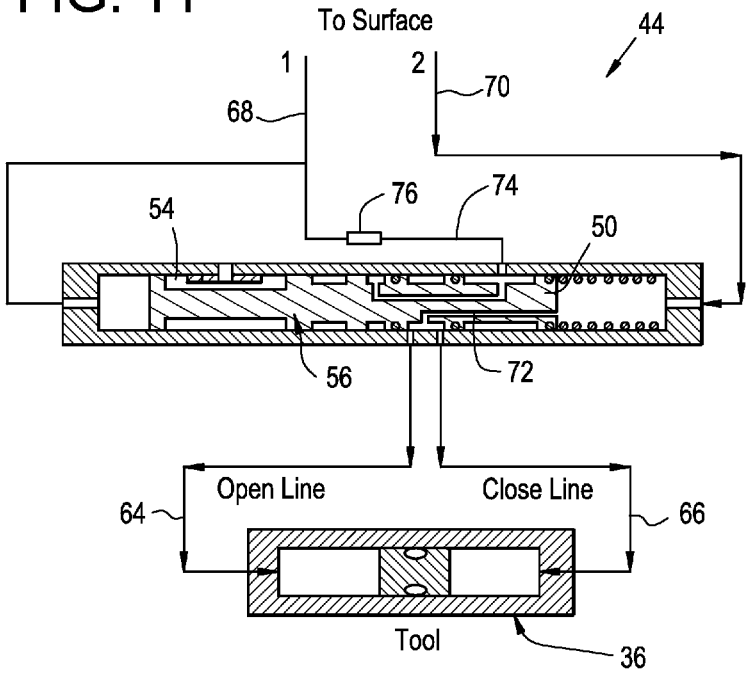
FIG. 11 is a view of the multidrop module illustrated in FIG. 10 but in a different state of actuation, according to an embodiment of the present invention.

Upon application of the predetermined number of pressure inputs to multidrop module 44 via control line 68, indexer 54 and multidrop module 44 are shifted to the no-actuation position, as illustrated in FIG. 11. Indexer 54 holds valve 50, via piston 56, at a position that prevents actuation of well tool 36 regardless of the fluid pressure applied along control line 70. The valve 50 remains in the no-actuation position until the appropriate number of pressure inputs are applied through control line 68 to cause shifting of indexer 54, and thus valve 50, to the second actuation position, e.g. the close tool position, illustrated in FIG. 12. In this position, hydraulic power can be transmitted along control line 70, through multidrop module 44 (via flow passage 72 through valve 50), and into the well tool actuation line 66 to actuate well tool 36 in a second direction, e.g. to close the well tool. Return fluid flows can be conducted through actuation line 64, through multidrop module 44, and into control line 68 via the secondary flow passage 74.

Again, each indexer can be programmed with a unique slot profile that corresponds to the desired number of pressure inputs required to transition the multidrop module 44 between the two actuation positions and the no-actuation position. The indexer program for each multidrop module may be unique relative to the indexer program for other multidrop modules. In some embodiments, each multidrop module may have its own individual program. Accordingly, every time control line 38 is pressurized with a pressure input, every multidrop module 44 transitions through an increment via its indexer 54. However, any resulting change in position of valve 50 depends on the unique program or slot profile of its indexer.

Figures 12, 13:
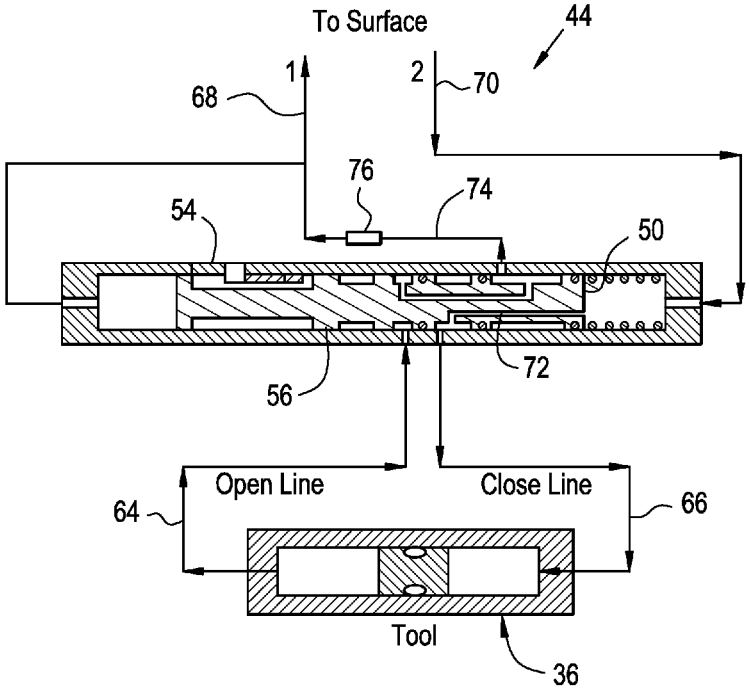
FIG. 12 is a view of the multidrop module illustrated in FIG. 10 but in a different state of actuation, according to an embodiment of the present invention.
FIG. 13 is a table illustrating one example of a multidrop module program for individually actuating specific well tools, according to an embodiment of the present invention.

As illustrated in FIG. 13, for example, a plurality of multidrop modules 44 can be uniquely programmed. In this example, a first pressure input to the multidrop modules 44 causes shifting of the first module to a first actuation position, while the second and third modules remain in a no-actuation position. A second pressure input causes the second incremental movement of the indexers 54 in each multidrop module 44, resulting in shifting of the first multidrop module to a second actuation position, while the second and third modules remain in a no-actuation position. A third pressure input applied to the multidrop modules causes the second multidrop module to shift to a first actuation position, while the first and third multidrop modules shift or remain in a no-actuation position. A fourth pressure input causes the second multidrop module to move to a second actuation position, while the first and third modules remain in a no-actuation position. A fifth pressure input causes the third multidrop module to shift to a first actuation position, while the first and second multidrop modules shift or remain in a no-actuation position. The sixth pressure input causes the third multidrop module to shift to a second actuation position, while the first and second multidrop modules remain in a no-actuation position. Here again, the pressure inputs can all be provided at the same pressure level.

Figures 14, 15:
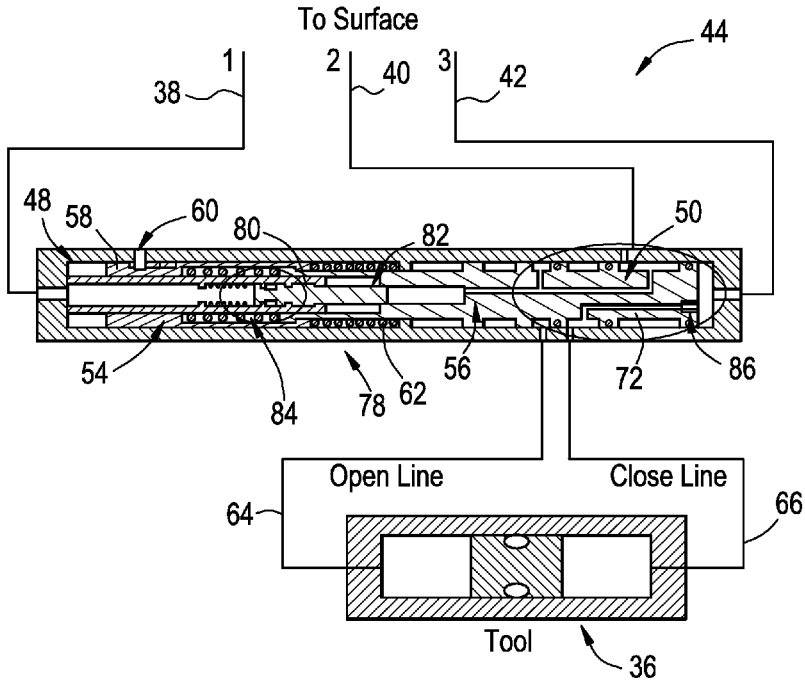
FIG. 14 is a table illustrating another example of a multidrop module program for individually actuating specific well tools, according to an alternate embodiment of the present invention.
FIG. 15 is a schematic illustration of one example of a multidrop module with a module program override mechanism, according to an embodiment of the present invention.

Similar to the first illustrated embodiment, this embodiment allows the use of many different programs for shifting the multidrop modules between first actuation, second actuation, and no-actuation positions, as desired for a specific application. Additionally, multiple or all of the multidrop modules can be programmed to shift to an actuation position or a no-actuation position at the same time. As illustrated in FIG. 14, for example, the first pressure input and the first incremental movement of the indexers 54 causes all of the illustrated multidrop modules to shift to a first actuation position. The second pressure input through control line 68 shifts the multidrop modules to a second actuation position. Subsequent pressure inputs may cause the multidrop modules to be individually transitioned between first actuation, second actuation, and no-actuation positions, as illustrated.

In another embodiment, each multidrop module may comprise an override mechanism that enables selective actuation of all well tools to a default position, e.g. a closed position, at any selected time. The override mechanism may be particularly useful in well actuation systems operating dual-line well tools.

Referring generally to FIG. 15, one embodiment of a multidrop module 44 incorporating an override mechanism 78 is illustrated. In this embodiment, the multidrop module 44 comprises a two position indexer 54, such as the indexer described with reference to FIG. 3, and a three position valve 50, such as the valve described with reference to FIG. 10. By way of example, the indexer 54 may utilize the J-slot indexer sleeve 58 that cooperates with indexer pin 60. However, the override mechanism 78 is able to override the J-slot indexer sleeve 58 at any time when a given sequence of pressure is applied. This allows all well tools 36 to be moved to a default position, such as a closed position, at any desired point of time.

Override mechanism 78 may have a variety of configurations designed to capture and hold valve 50 at a position that allows fluid flow through the multidrop module 44 to actuate well tool 36 to a desired default position. In the embodiment illustrated, however, override mechanism 78 comprises a locking mechanism 80 mounted within housing 48 and having a portion slidably received in an extended portion 82 of piston 56. Valve 50 and extended portion 82 can be forced along locking mechanism 80 toward the close-all-tools position. Movement of extended portion 82 along locking mechanism 80 compresses an override mechanism spring 84.

Figure 16:
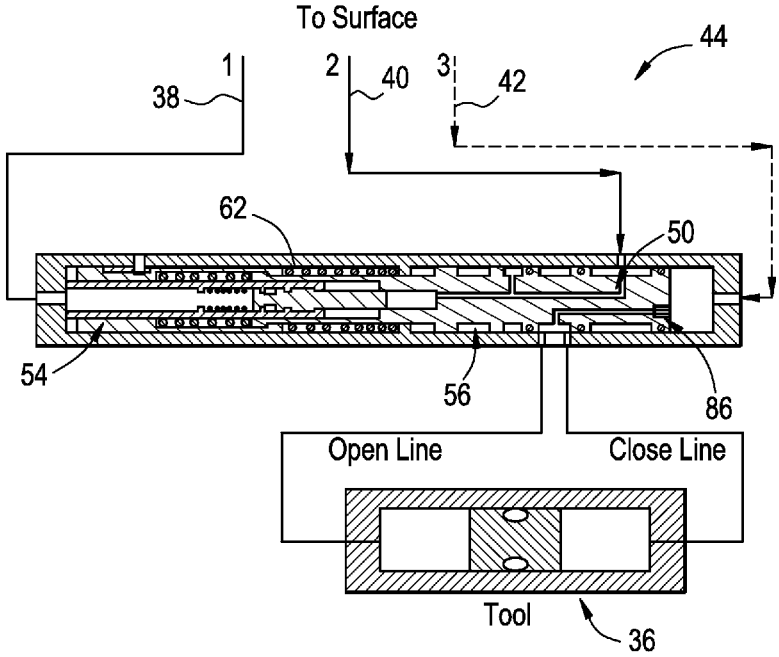
FIG. 16 is a view of the multidrop module illustrated in FIG. 15 but with a different flow pattern, according to another embodiment of the present invention.

The multidrop module 44 illustrated in FIG. 15 can be shifted between an actuation position, e.g. an open tool position, a no-actuation position, e.g. cannot open tool position, and a close-all-tools position. The indexer 54 is used to selectively transition valve 50 between the first two operational positions. For example, the indexer 54 can be used to transition multidrop module 44 to the actuation position, illustrated best in FIG. 15. In this position, fluid under pressure can be supplied through control line 40 and routed through valve 50 to actuation line 64 for actuating, e.g. opening, the well tool 36. Application of pressure inputs through control line 38 moves indexer 54 the desired number of increments to transition valve 50 and multidrop module 44 to the no-actuation position, illustrated in FIG. 16. The indexer 54 is operated as described above by applying pressure inputs, e.g. single level pressure inputs, via control line 38 which shift piston 56 in one direction, while return spring 62 causes movement in the opposite direction to incrementally shift indexer 54 along its predetermined profile. In the position illustrated in FIG. 16, tool 36 cannot be actuated even if fluid is supplied via control line 40 and/or control line 42. Any fluid supplied by control line 42 is blocked from moving through valve 50 by a check valve 86.

Figure 17:
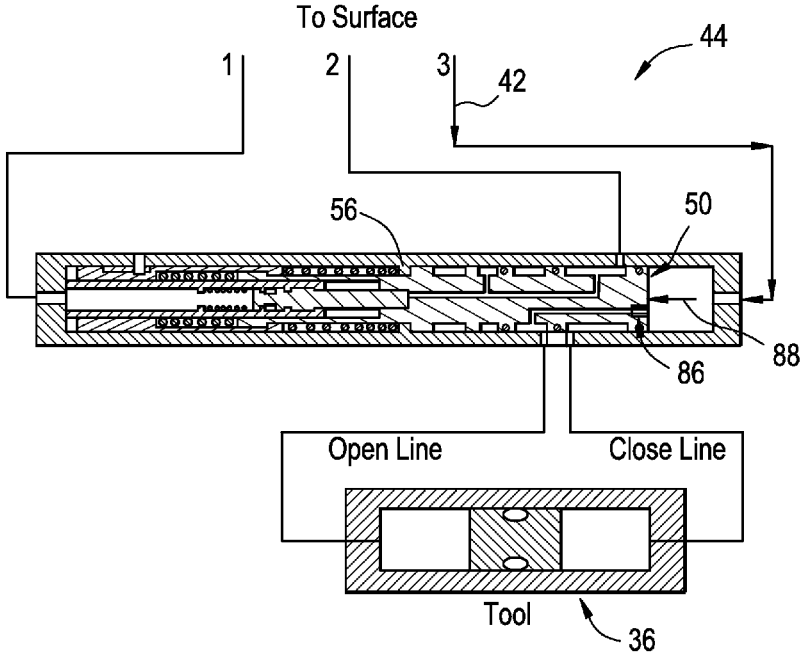
FIG. 17 is a view of the multidrop module illustrated in FIG. 15 but with a different flow pattern, according to another embodiment of the present invention.
Figure 18:
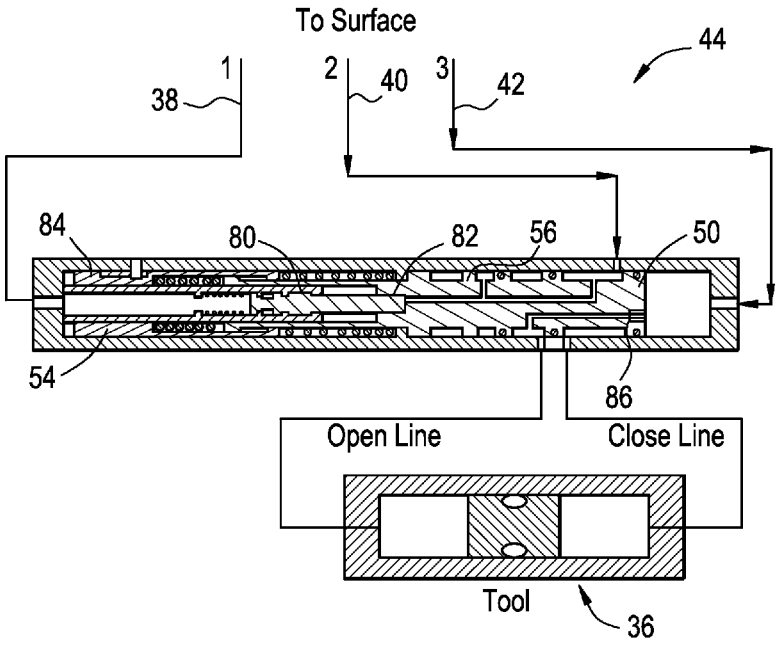
FIG. 18 is a view of the multidrop module illustrated in FIG. 15 but with a different flow pattern, according to another embodiment of the present invention.
Figure 19:
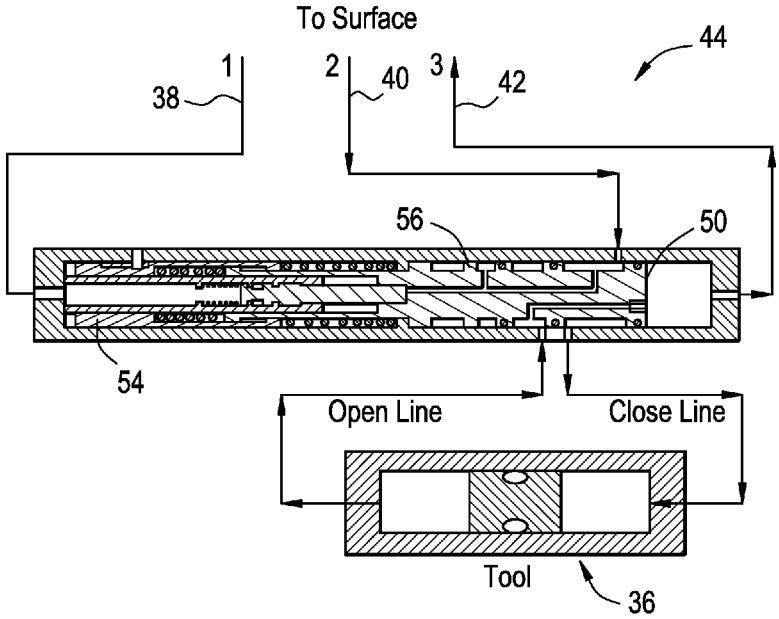
FIG. 19 is a view of the multidrop module illustrated in FIG. 15 but with a different flow pattern, according to another embodiment of the present invention.

However, all of the valves 50 of the plurality of multidrop modules 44 can be shifted to the close-all-tools position by application of a given pressure sequence. For example, sufficient pressure can be applied via control line 42 to act against valve 50 and to cause valve 50 to shift to the left, as illustrated in FIG. 17 by arrow 88. Check valve 86 prevents pressure from being transmitted to well tool 36. The translation of valve 50 and piston 56 compresses override mechanism spring 84 until piston extension 82 slides a sufficient distance over locking mechanism 80, as illustrated in FIG. 18. While spring 84 is compressed, the two position indexer 54 does not move. Furthermore, while maintaining pressure in control line 42, pressure is applied through control line 40 to cause translation of locking mechanism 80 in a manner that holds or locks main piston 56 and valve 50 in the close-all-tools position. The piston 56 remains in this position as long as pressure is maintained in control line 40. At this stage, pressure can be bled from control line 42 which allows the pressurized fluid in control line 40 to shift well tool 36 to a default position, e.g. a closed position, as illustrated in FIG. 19. The ability to shift all multidrop modules 44 to the close-all-tools position enables all of the well tools 36 to be simultaneously actuated to a desired default position. In other words, the programmed valve positions directed by indexers 54 can be overridden to force all well tools 36 to the default position. If, for example, the well tools 36 comprise downhole valves, all the valves can be forced to a closed position at any time.

Figure 20:
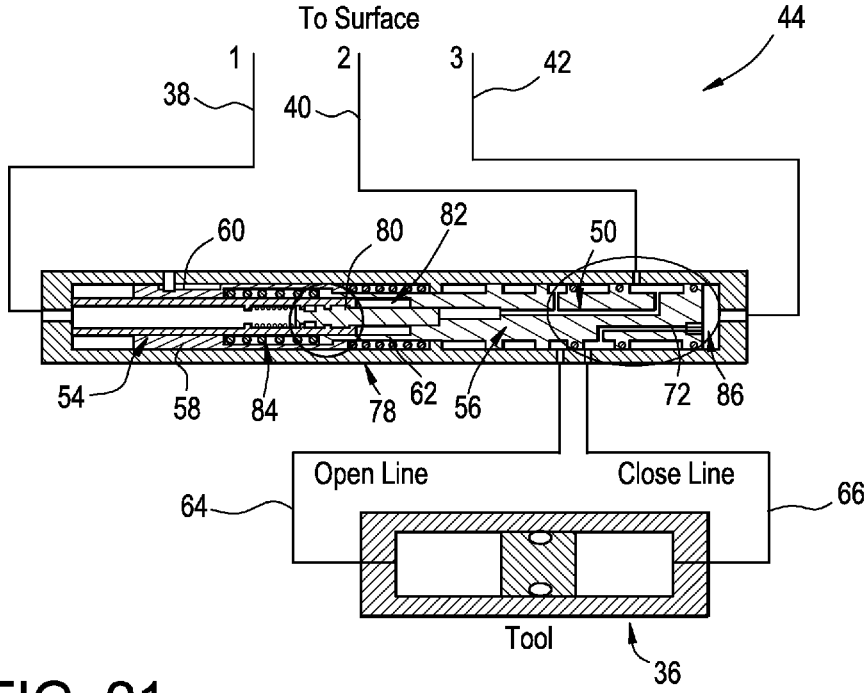
FIG. 20 is a schematic illustration of another example of a multidrop module with a module program override mechanism, according to an alternate embodiment of the present invention.

Another embodiment of multidrop module 44 is illustrated in FIG. 20. In this embodiment, multidrop module 44 combines the override mechanism 78 with a three position valve 50 and a three position indexer 54. The three position valve 50 in combination with the three position indexer 54 enables valve 50 and multidrop module 44 to have a first actuation position, e.g. open tool position, a second actuation position, e.g. a close tool position, and a no-actuation position. Additionally, the override mechanism 78 enables all of the valves 50 and all of the multidrop modules 44 in a given well tool actuation system 30 (e.g., see FIG. 1) to be moved to a default position simultaneously. As described above, when a given pressure sequence is applied, the override mechanism 78 is able to override the valve positions determined by the indexers 54. For example, all of the well tools in system 30 can be moved to a closed position simultaneously.

Figure 21:
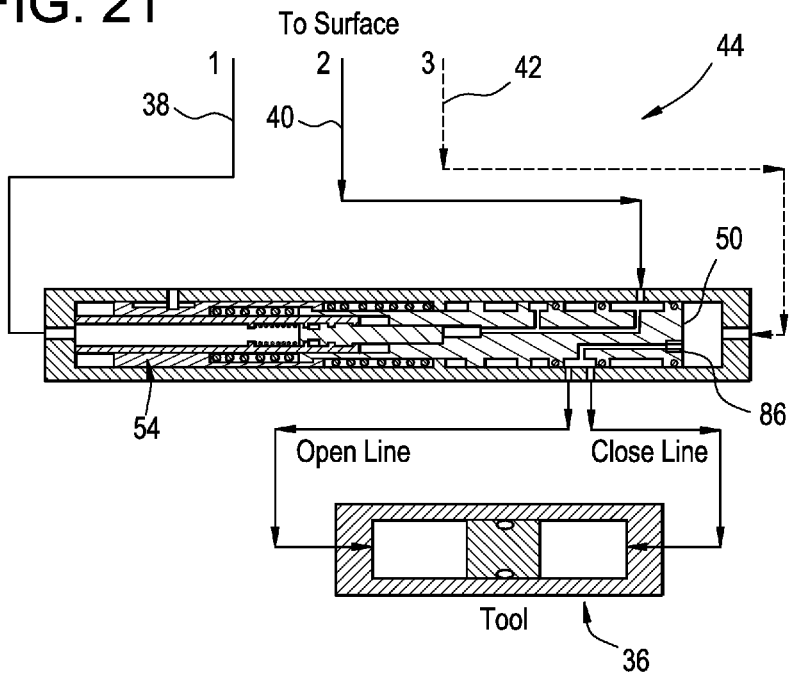
FIG. 21 is a view of the multidrop module illustrated in FIG. 20 but with a different flow pattern, according to another embodiment of the present invention.
Figure 22:
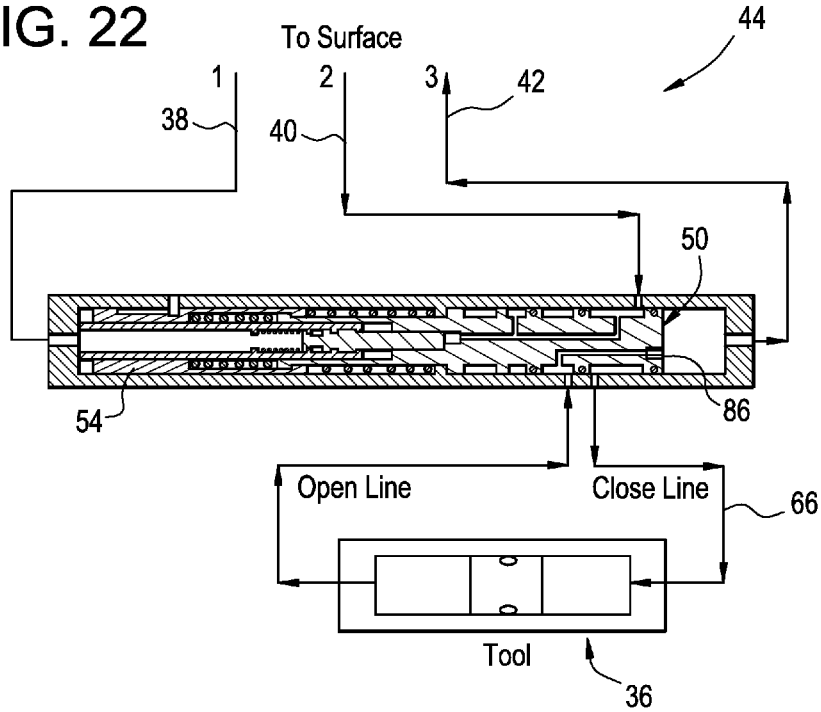
FIG. 22 is a view of the multidrop module illustrated in FIG. 20 but with a different flow pattern, according to another embodiment of the present invention.

In FIG. 20, valve 50 and multidrop module 44 are positioned in the first actuation, e.g. open tool, position. In this position, hydraulic power can be transmitted along control line 40, through multidrop module 44, and into a well tool actuation line 64 to actuate well tool 36 in a first direction. For example, if well tool 36 comprises a valve, actuation line 64 may be an "open" line that enables opening of the valve. Upon input of the predetermined number of pressure inputs to move indexer 54 through a corresponding predetermined number of increments, valve 50 and multidrop module 44 may be shifted to a no-actuation position, as illustrated in FIG. 21. In this position, valve 50 prevents actuation of well tool 36 regardless of whether tool actuation fluid is supplied through control line 40 or control line 42. An additional pressure input or inputs via control line 38 causes indexer 54 to shift valve 50 to the second actuation, e.g. close tool, position. In this position, pressurized fluid can again flow through control line 40, multidrop module 44, and actuation line 66 to actuate well tool 36, e.g. close well tool 36, as illustrated in FIG. 22. Whether well tool 36 is actuated to the first actuation position or the second actuation position, return fluids can be routed through multidrop module 44, through check valve 86, and into control line 42.

Figure 23:
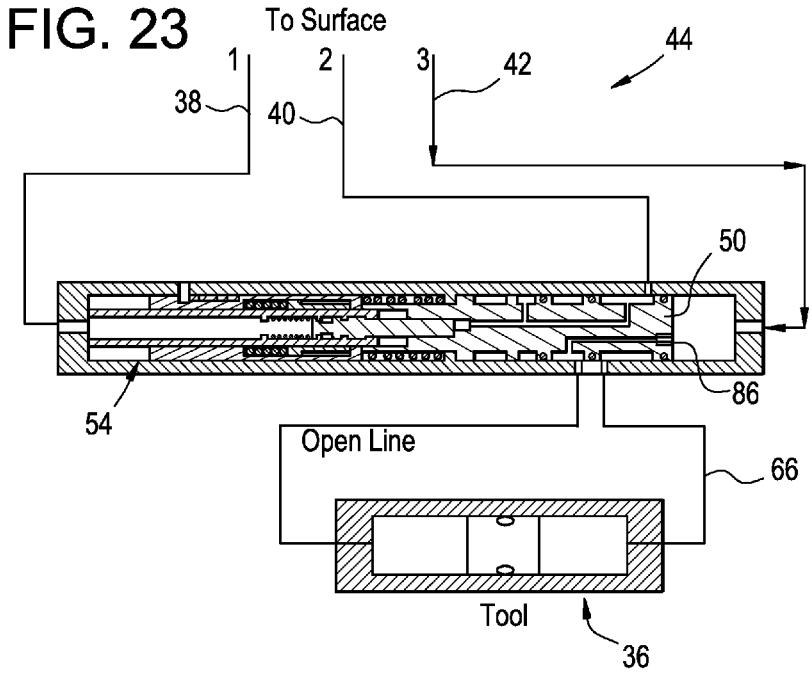
FIG. 23 is a view of the multidrop module illustrated in FIG. 20 but with a different flow pattern, according to another embodiment of the present invention.
Figure 24:
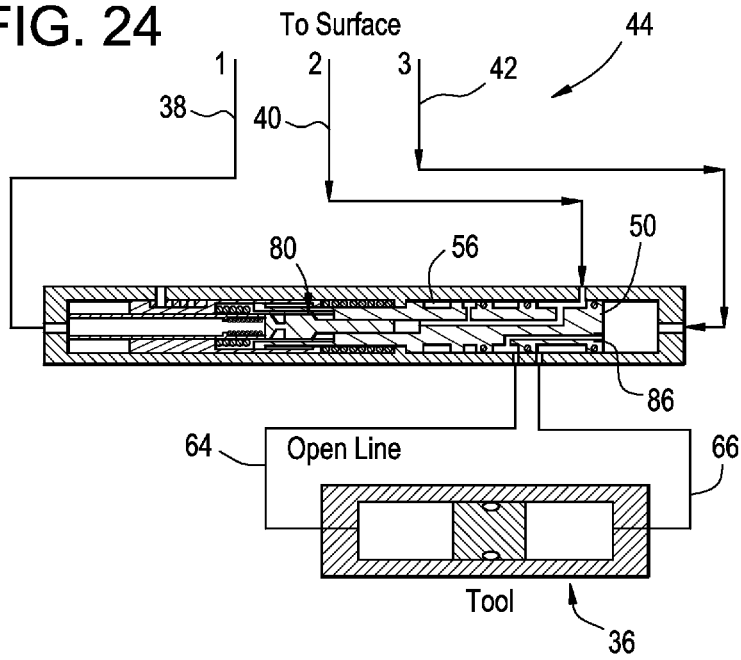
FIG. 24 is a view of the multidrop module illustrated in FIG. 20 but with a different flow pattern, according to another embodiment of the present invention.
Figure 25:
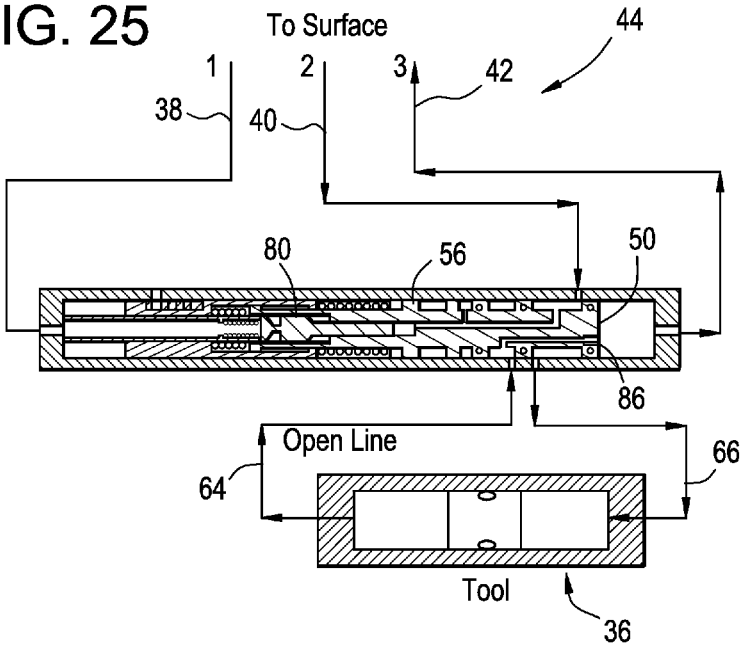
FIG. 25 is a view of the multidrop module illustrated in FIG. 20 but with a different flow pattern, according to another embodiment of the present invention.

The latter embodiment also enables simultaneous shifting of all valves 50 and all multidrop modules 44 to a default position at any selected time upon the application of a given pressure sequence. If well tool actuation system 30 (e.g., see FIG. 1) comprises well tools in the form of valves, for example, all the valves can be closed simultaneously at any desired time. To override the programmed tool positions, sufficient pressure is applied via control line 42 to act against valve 50 and cause valve 50 to shift to the left, as illustrated in FIG. 23. Check valve 86 again prevents pressure from being transmitted to well tool 36. While maintaining pressure in control line 42, pressure is applied through control line 40 to cause translation of locking mechanism 80 in a manner that holds or locks main piston 56 and valve 50 in the close-all-tools position, as illustrated in FIG. 24. At this stage, pressure can be bled from control line 42 which allows the pressurized fluid in control line 40 to shift well tool 36 to the default position, e.g. the closed position, as illustrated in FIG. 25. Any return fluids can freely flow through actuation line 64, through check valve 86, and into control line 42. All of the well tools 36 can be similarly and simultaneously closed or otherwise actuated to a default position.

Well tool actuation system 30 (e.g., see FIGS. 1, 2, 8 and 9) can be designed in a variety of configurations for use in a variety of wellbores and other subterranean environments. The number of multidrop modules can be greater and even substantially greater than the number of control lines used to control the multidrop modules and their corresponding well tools. Additionally, even if the multidrop modules are greater in number than the control lines, the multidrop modules and their corresponding well tools can be controlled individually with pressure inputs directed to all of the multidrop modules at a single pressure level. Furthermore, the type and configuration of the well tools 36 and the multidrop modules 44 can differ from one application to another (e.g., see FIGS. 3, 10 and 15). The components within the multidrop modules also can be selected according to the desired actuation for a given application or environment. For example, a variety of valve styles and indexer styles can be utilized in a given multidrop module. Additionally, the override mechanism can be constructed in different forms, and a variety of locking mechanisms can be used to hold the valves in the override position.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a well, comprising:

a plurality of well tools, each well tool being actuatable between a first operational position and a second operational position;

a plurality of multidrop modules, each multidrop module being coupled to a corresponding well tool of the plurality of well tools; and at least two control lines coupled to the plurality of multidrop modules, the number of well tools being greater than the number of control lines, each well tool being actuatable individually by a unique number of single pressure level signals applied to the plurality of multidrop modules via an individual control line of the least two control lines.

2. The system as recited in claim 1, wherein the at least to control lines comprise three control lines.

3. The system as recited in claim 1, wherein the plurality of well tools comprises a plurality of valves.

4. The system as recited in claim 1, wherein each multidrop module comprises a unique indexer programmed to position the multidrop module in an actuation position, enabling actuation of the well tool, and a no-actuation position.

5. The system as recited in claim 1, wherein each multidrop module is coupled to a single, dual-line well tool.

6. The system as recited in claim 1, wherein each multidrop module is coupled to a pair of single-line well tools.

7. The system as recited in claim 1, further comprising an override mechanism to enable closure of all of the plurality of well tools at any selected time.

8. A system for use in a well, comprising:

a plurality of well tools; and;

a plurality of multidrop modules, each multidrop module being coupled to a corresponding well tool to selectively enable actuation of the corresponding well tool when the multidrop module is transitioned to an actuation position, each multidrop module comprising an indexer programmed to transition the multidrop module to the actuation position upon receipt of a predetermined number of pressure signals applied at the same pressure level through an individual control line, the predetermined number being unique relative to the number of pressure signals required to enable actuation of other well tools.

9. The system as recited in claim 8, further comprising a pair of hydraulic control lines coupled to the plurality of multidrop modules, the number of multidrop modules being greater than the number of hydraulic control lines.

10. The system as recited in claim 8, further comprising three hydraulic control lines coupled to the plurality of multidrop modules, the number of multidrop modules being greater than the number of hydraulic control lines.

11. The system as recited in claim 8, wherein each multidrop module comprises a two position valve coupled to a J-slot indexer sleeve.

12. The system as recited in claim 11, wherein the two position valve is shiftable between the actuation position and a no-actuation position.

13. The system as recited in claim 8, wherein each multidrop module comprises a three position valve coupled to a J-slot indexer sleeve.

14. The system as recited in claim 13, wherein the three position valve is shiftable between an open actuation position, a close actuation position, and a no-actuation position.

15. The system as recited in claim 8, wherein each multidrop module is coupled to a pair of single-line tools.

16. The system as recited in claim 8, further comprising an override mechanism to enable closure of all of the well tools at any selected time.

17. A method, comprising:

connecting a plurality of multidrop modules to a plurality of corresponding well tools to control actuation of the plurality of corresponding well tools;

coupling at least two hydraulic control lines to the plurality of multidrop modules;

selectively transitioning each multidrop module to desired operational states by applying a unique number of single-level pressure inputs through at least one of the hydraulic control line; and individually controlling a greater number of multidrop modules than the number of hydraulic control lines coupled to the multidrop modules in a manner so the greater number of multidrop modules is not a function of the number of control lines.

18. The method as recited in claim 17, wherein connecting comprises connecting a dual-line well tool to each multidrop module.

19. The method as recited in claim 17, wherein connecting comprises connecting a pair of single-line well tools to each multidrop module.

20. The method as recited in claim 17, wherein selectively transitioning comprises controlling the plurality of multidrop modules with a plurality of indexers that are each programmed to uniquely correspond to the desired actuation of a specific well tool.

21. The method as recited in claim 17, further comprising utilizing an override mechanism in each multidrop module to simultaneously close all of the corresponding well tools.

22. A method, comprising:

forming a plurality of multidrop modules such that each multidrop module has a unique indexer that may be indexed via pressure signals;

programming each unique indexer to enable actuation of a corresponding well tool upon application of a unique number of the pressure signals associated with the corresponding well tool;

delivering the pressure signals downhole into a wellbore via at least one hydraulic control line; and individually controlling a greater number of well tools than the number of hydraulic lines by selectively applying the unique number of pressure signals through an individual hydraulic control line coupled to a plurality of the well tools for controlling the plurality of the well tools.

23. The method as recited in claim 22, further comprising utilizing an override mechanism in each multidrop module to simultaneously close all the corresponding well tools.

* * * * *